US010304436B2

(12) United States Patent
Tajika

(10) Patent No.: US 10,304,436 B2
(45) Date of Patent: May 28, 2019

(54) ELECTRONIC MUSICAL INSTRUMENT, MUSICAL SOUND GENERATING METHOD, AND STORAGE MEDIUM

(71) Applicant: CASIO COMPUTER CO., LTD., Tokyo (JP)

(72) Inventor: Yoshinori Tajika, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/913,640

(22) Filed: Mar. 6, 2018

(65) Prior Publication Data

US 2018/0261198 A1 Sep. 13, 2018

(30) Foreign Application Priority Data

Mar. 9, 2017 (JP) ..... 2017-044874

(51) Int. Cl.
*G10H 1/18* (2006.01)
*G10H 1/20* (2006.01)
(Continued)

(52) U.S. Cl.
CPC ..... *G10H 7/008* (2013.01); *G10H 1/0008* (2013.01); *G10H 1/0091* (2013.01); *G10H 1/053* (2013.01);
(Continued)

(58) Field of Classification Search
CPC ..... G10H 1/00; G10H 2210/066; G10H 2210/331; G10H 2240/145; G10K 15/02; G10K 15/12
See application file for complete search history.

(56) References Cited

U.S. PATENT DOCUMENTS 5,831,193 A * 11/1998 Suzuki ..... G10H 7/002 84/603
6,002,080 A 12/1999 Tanaka
(Continued)

FOREIGN PATENT DOCUMENTS

EP 1 653 441 A1 5/2006
JP H03-116096 A 5/1991
(Continued)

OTHER PUBLICATIONS

European Search Report dated May 8, 2018, in a counterpart European patent application No. 18160757.3.

*Primary Examiner* — Marlon T Fletcher
(74) *Attorney, Agent, or Firm* — Chen Yoshimura LLP

(57) ABSTRACT

An electronic musical instrument includes a plurality of keys respectively specifying different pitches when operated; a memory; and a sound processor. In response to a current operation of a current key, which is one of the plurality of keys, the sound processor retrieves the information stored in the memory for a previous operation, if any, of a previous key, which is a same as the current key or is another one of the plurality of keys, and performs a prescribed processing on a beginning part of the waveform data generated for the current operation of the current key in accordance with the retrieved information stored in the memory for the previous operation of the previous key so as to generate processed waveform data in response to the current operation of the current key. The resulting processed waveform data can be configured to better mimic artists' performance of an original instrument.

11 Claims, 7 Drawing Sheets

(51) Int. Cl.

| | |
|---|---|
| ***G10H 7/00*** | (2006.01) |
| ***G10H 1/00*** | (2006.01) |
| ***G10H 1/053*** | (2006.01) |
| ***G10H 1/34*** | (2006.01) |

(52) U.S. Cl.
CPC ..... *G10H 1/344* (2013.01); *G10H 2210/095* (2013.01); *G10H 2210/221* (2013.01); *G10H 2210/325* (2013.01); *G10H 2220/221* (2013.01); *G10H 2240/161* (2013.01)

(56) References Cited

U.S. PATENT DOCUMENTS

| | | | | |
|---|---|---|---|---|
| 6,657,114 | B2 * | 12/2003 | Iwamoto | G10H 1/366 434/307 A |
| 2001/0037196 | A1 * | 11/2001 | Iwamoto | G10H 1/366 704/207 |
| 2009/0158919 | A1 | 6/2009 | Akazawa | |
| 2013/0174714 | A1 * | 7/2013 | Adachi | G10H 7/02 84/603 |
| 2013/0174715 | A1 * | 7/2013 | Akiyama | G10H 7/008 84/604 |
| 2013/0174718 | A1 * | 7/2013 | Maruyama | G10H 5/00 84/624 |

FOREIGN PATENT DOCUMENTS

| | | | |
|---|---|---|---|
| JP | H07-168565 | A | 7/1995 |
| JP | H07-191669 | A | 7/1995 |
| JP | H10-78791 | A | 3/1998 |
| JP | 2002-149159 | A | 5/2002 |

* cited by examiner

T1

| NOTE NUMBER DIFFERENCE N (MIDI VALUE) | PITCH SHIFT AMOUNT (CENT) |
|---|---|
| 127 | 2 |
| ⋮ | ⋮ |
| 0 | 0 |
| ⋮ | ⋮ |
| −127 | −2 |

| NOTE NUMBER DIFFERENCE N (MIDI VALUE) | PITCH SHIFT AMOUNT (CENT) | VOLUME CHANGE AMOUNT (dB) |
|---|---|---|
| 127 | 2 | 2 |
| ⋮ | ⋮ | ⋮ |
| 0 | 0 | 0 |
| ⋮ | ⋮ | ⋮ |
| −127 | −2 | −2 |

T2

FIG. 6

| VELOCITY DIFFERENCE V (MIDI VALUE) | PITCH SHIFT AMOUNT (CENT) | VOLUME CHANGE AMOUNT (dB) |
|---|---|---|
| 127 | 2 | 2 |
| ⋮ | ⋮ | ⋮ |
| 0 | 0 | 0 |
| ⋮ | ⋮ | ⋮ |
| −127 | −2 | −2 |

T3

FIG. 7

| READ-IN TIME DIFFERENCE T (ms) | PITCH SHIFT AMOUNT (CENT) | VOLUME CHANGE AMOUNT (dB) |
|---|---|---|
| 50 | 2 | 2 |
| ⋮ | ⋮ | ⋮ |
| 1000 | 0 | 0 |

T4

FIG. 9

ELECTRONIC MUSICAL INSTRUMENT, MUSICAL SOUND GENERATING METHOD, AND STORAGE MEDIUM

BACKGROUND OF THE INVENTION

Technical Field

The present invention relates to an electronic musical instrument, a musical sound generating method, and a storage medium that reproduce the manner in which sound is produced when a person plays an acoustic musical instrument or the like or the manner in which a person sings.

Background Art

Heretofore, a variety of technologies have been developed for reproducing the tone colors of various acoustic musical instruments such as wind instruments and string instruments in electronic musical instruments. In an electronic musical instrument, the individual keys and the pitches of output sounds are associated with each other, and when a certain key is pressed, sound of a desired pitch (frequency) is always output. In contrast, the control of sound production in an acoustic musical instrument such as a string instrument or a wind instrument is strongly dependent on the performance technique of the performer, and therefore the pitch of the produced sound is often shifted from the desired pitch. However, there is an aspect that these shifts in pitch lead to expression of the tone color characteristic of the instrument. Furthermore, such pitch shifts are recognized not only in the case where a person plays an acoustic musical instrument, but also in the case where a person sings. Therefore, the sound of an electronic musical instrument that does not cause such a pitch shift to be generated gives the performer or audiences a different impression from the sound of an acoustic musical instrument or the singing voice of a person.

In relation to the above-described problem, technologies have been disclosed in which the pitch is made to change by, for example, stretching or contracting the waveform in the time-axis direction (for example, see Patent Document 1).

<Patent Document 1> Japanese Patent Application Laid-Open Publication No. H10-78791

However, the technology disclosed in above-listed Patent Document 1 does not cause the pitch to change in accordance with the performance condition of an acoustic musical instrument or the singing condition of a person. Consequently, there is a problem in that the technology disclosed in Patent Document 1 is not able to reproduce the pitch shift that is observed when a person plays an acoustic musical instrument or a person sings as described above.

SUMMARY OF THE INVENTION

Accordingly, the present invention is directed to a scheme that substantially obviates one or more of the problems due to limitations and disadvantages of the related art. The present invention can provide an electronic musical instrument, a musical sound generating method, and a storage medium that can reproduce the manner in which sound is produced when a person plays an acoustic musical instrument or the like or the manner in which a person sings.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument including: a plurality of keys respectively specifying different pitches when operated; a memory; and a sound processor that executes the following: in response to an operation of any one of the keys, generating waveform data corresponding to a pitch specified by the operated key; and storing information on the operation of the operated key in the memory, wherein in response to a current operation of a current key, which is one of the plurality of keys, the sound processor retrieves the information stored in the memory for a previous operation, if any, of a previous key, which is a same as the current key or is another one of the plurality of keys, and performs a prescribed processing on a beginning part of the waveform data generated for the current operation of the current key in accordance with the retrieved information stored in the memory for the previous operation of the previous key so as to generate processed waveform data in response to the current operation of the current key, and wherein the sound processor causes the processed waveform data to output as a sound.

In another aspect, the present disclosure provides a method performed by a sound processor in an electronic musical instrument that includes a plurality of keys respectively specifying different pitches when operated; a memory; and the sound processor, wherein in response to an operation of any one of the keys, the processor generates waveform data corresponding to a pitch specified by the operated key; and stores information on the operation of the operated key in the memory, the method including: in response to a current operation of a current key, which is one of the plurality of keys, retrieving the information stored in the memory for a previous operation, if any, of a previous key, which is a same as the current key or is another one of the plurality of keys; performing a prescribed processing on a beginning part of the waveform data generated for the current operation of the current key in accordance with the retrieved information stored in the memory for the previous operation of the previous key so as to generate processed waveform data in response to the current operation of the current key; and causing the processed waveform data to output as a sound.

In another aspect, the present disclosure provides a non-transitory computer-readable storage medium having stored thereon a program executable by a sound processor in an electronic musical instrument that includes a plurality of keys respectively specifying different pitches when operated; a memory; and the sound processor, wherein in response to an operation of any one of the keys, the processor generates waveform data corresponding to a pitch specified by the operated key; and stores information on the operation of the operated key in the memory, the program causing the sound processor to perform the following: in response to a current operation of a current key, which is one of the plurality of keys, retrieving the information stored in the memory for a previous operation, if any, of a previous key, which is a same as the current key or is another one of the plurality of keys; performing a prescribed processing on a beginning part of the waveform data generated for the current operation of the current key in accordance with the retrieved information stored in the memory for the previous operation of the previous key so as to generate processed waveform data in response to the current operation of the current key; and causing the processed waveform data to output as a sound. It is to be understood that both the foregoing general description and the following detailed description are exemplary and explanatory, and are intended to provide further explanation of the invention as claimed.

BRIEF DESCRIPTION OF THE DRAWINGS

The present application can be better understood by considering the following detailed description together with the accompanying drawings.

FIG. 6 is a diagram illustrating the relationships between a note number difference, a pitch shift amount, and a volume change amount.

FIG. 7 is a diagram illustrating the relationships between a velocity difference, a pitch shift amount, and a volume change amount.

FIG. 9 is a diagram illustrating the relationships between a read-in time difference, a pitch shift amount, and a volume change amount.

DETAILED DESCRIPTION OF EMBODIMENTS

Figure 1:
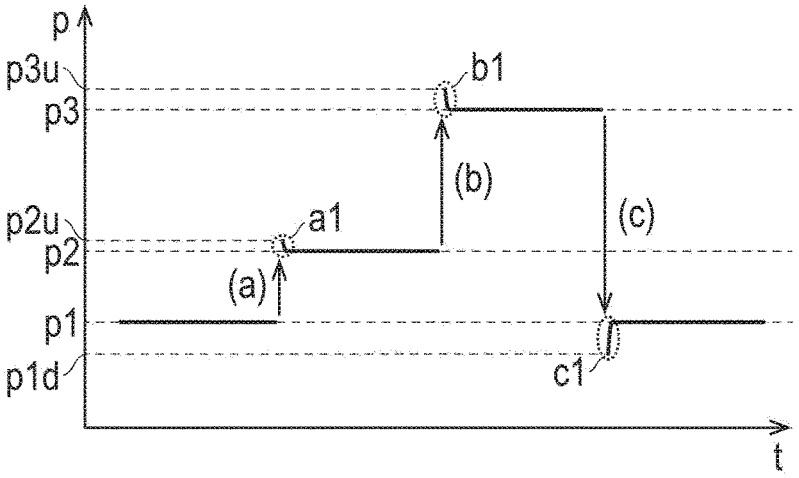
FIG. 1 is a diagram illustrating examples of pitch changes that occur when an acoustic musical instrument is played.

Hereafter, the principles of the present invention will be described and then embodiments based on the principles of the present invention will be described while referring to the drawings. The dimensional ratios in the drawings are exaggerated for convenience of explanation and may differ from the actual ratios.

<Principles of Invention>

FIG. 1 is a diagram illustrating examples of pitch changes that occur when an acoustic musical instrument is played.

As illustrated in FIG. 1, as a piece of music progresses with the passage of time t, the pitch of the sound produced by the acoustic musical instrument changes. For example, as indicated by arrow (a), the pitch changes from p1 to p2 with a change in pitch. In this case, the sound produced at al, which is immediately after the pitch change, begins to be produced at a pitch p2u, which is higher than an originally desired pitch p2. Thus, as a result of it being difficult to control sound production when causing the pitch of the sound to change in an acoustic musical instrument such as a string instrument or a wind instrument, the pitch of the sound produced after the change in pitch is likely to be shifted from the desired pitch.

This tendency is more noticeable, the larger the change in pitch is. For example, as indicated by arrow (b), a case is assumed in which the pitch changes from p2 to p3 as the pitch changes with a change width that is larger than the change width indicated by arrow (a). In this case, the sound produced at b1, which is immediately after the pitch change, begins to be produced at a pitch p3u, which is higher than an originally desired pitch p3, and the pitch shift width (p3u-p3) is even larger than the shift width (p2u-p2).

Furthermore, as indicated by arrow (c), when the pitch changes from p3 to p1, the sound produced at c1, which is immediately after the pitch change, begins to be produced at a pitch p1d, which is lower than the originally desired pitch p1. Thus, the sound that is produced after a change in pitch begins to be produced at a pitch that is higher than the originally desired pitch or begins to be produced at a pitch that is lower than the originally desired pitch depending on whether the pitch after the change in pitch is higher than or lower than the pitch before the change in pitch. Meanwhile, whether the sound begins to be produced at a pitch that is higher than the originally desired pitch or begins to be produced at a pitch that is lower than the originally desired pitch also depends on the skill of the performer.

The present invention reproduces the pitch shifts that commonly occur when an acoustic musical instrument is played, as described above. Furthermore, as described above, such pitch shifts are recognized not only in the case where a person plays an acoustic musical instrument but also in the case where a person sings. Therefore, the present invention is similarly applicable when outputting a singing voice from an electronic musical instrument.

EMBODIMENTS OF THE INVENTION (1) Configuration

Figure 2:
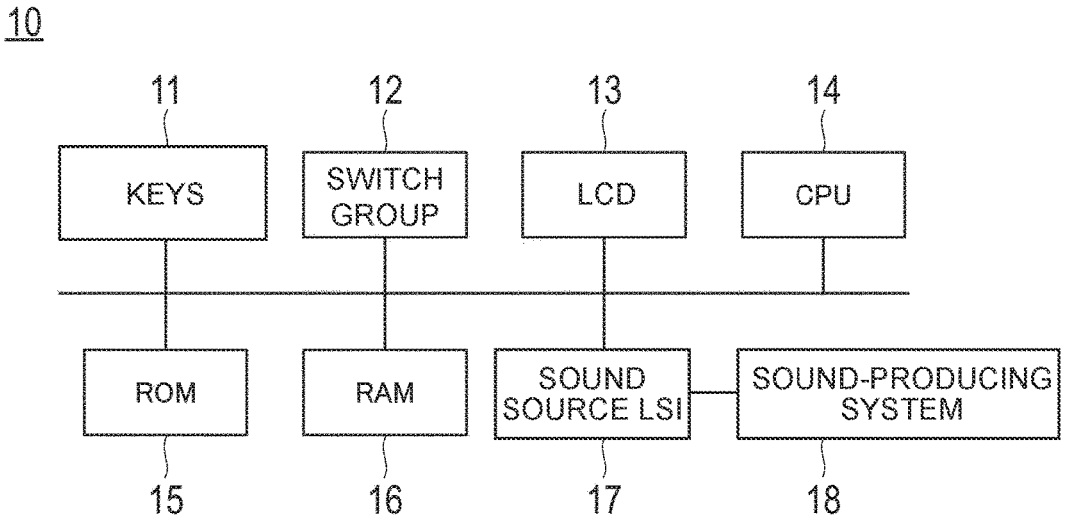
FIG. 2 is a block diagram illustrating a basic configuration of an electronic musical instrument according to an embodiment of the present invention.

FIG. 2 is a block diagram illustrating a basic configuration of an electronic musical instrument according to an embodiment of the present invention.

As illustrated in FIG. 2, an electronic musical instrument 10 includes a plurality of keys 11, a switch group 12, an LCD 13, a CPU 14, a ROM 15, a RAM 16, a sound source LSI 17, and a sound-producing system 18. These constituent components are connected to each other via a bus.

The plurality of keys 11 (at least a first key that specifies a first pitch and a second key that specifies a second pitch) causes performance information to be generated that includes key on/key off events, note numbers, and velocities on the basis of key pressing/releasing operations of the individual keys. A "note number" is information representing an operator operated by a performer. A "velocity" is, for example, a value that is calculated on the basis of a difference in detection time between at least two contacts that are included in a key and that detect pressing of the key, and is information that represents the output sound volume.

The switch group 12 includes various switches such as a power switch, a tone color switch, and so on that are arranged on a panel of the electronic musical instrument 10, and causes switch events to be produced based on switch operations.

The LCD 13 includes an LCD panel and so forth, and displays the setting state, the operation mode and so on of each part of the electronic musical instrument 10 on the basis of display control signals supplied from the CPU 14, which will be described later.

The CPU 14 executes control of each part of the electronic musical instrument 10, various arithmetic processing operations, and so on in accordance with a program. The CPU 14, for example, generates a note-on command that instructs production of a sound and a note-off command that instructs stopping of producing the sound on the basis of performance information supplied from the plurality of keys 11, and transmits the commands to the sound source LSI 17, which will be described later. In addition, the CPU 14, for example, controls the operation state of each part of the electronic musical instrument 10 on the basis of switch events supplied from the switch group 12. The processing performed by the CPU 14 will be described in detail later.

The ROM 15 includes a program area and a data area, and stores various programs, various data, and so on. For example, a CPU control program is stored in the program area of the ROM 15, and a processing table, which will be described later, is stored in the data area of the ROM 15.

The RAM 16 functions as a work area and temporarily stores various data, various registers, and so on.

The sound source LSI 17 employs a known waveform memory read out system, and stores waveform data in a waveform memory thereinside and executes various arithmetic processing operations. Examples of the waveform data stored in the sound source LSI 17 include musical sound waveform data of a wind instrument, musical sound waveform data of a string instrument, and singing voice waveform data of a singing voice. The sound source LSI 17, for example, processes waveform data, which is determined on the basis of note-on command information (hereafter, also referred to as "note-on information" and "sound production instruction information"), on the basis of the processing table stored in the ROM 15. Then, the sound source LSI 17 outputs a digital musical sound signal based on the processed waveform data. Processing of the waveform data and processing performed by the sound source LSI 17 will be described in detail later.

The sound-producing system 18 includes an audio circuit and speakers, and is controlled by the CPU 14 so as to output sound. Using the audio circuit, the sound-producing system 18 converts the digital musical sound signal into an analog musical sound signal, performs filtering and so on to remove unwanted noise, and performs level amplification. In addition, the sound-producing system 18 outputs musical sound based on the analog musical sound signal using the speakers.

(2) Processing of Waveform Data

As described above, a shift in the pitch of a sound occurs after there is a change in pitch in an actual acoustic musical instrument or the singing voice of a person. Therefore, in this embodiment, in order to reproduce this shift, waveform data that is determined on the basis of information of the note-on command (second note-on command) that causes the pitch change is subjected to prescribed processing in accordance with a difference in information between two consecutive note-on commands. Hereafter, pitch shift processing (pitch change processing) will be described in which a pitch shift is reproduced in accordance with a difference between information included in two consecutive note-on commands.

Figures 3A, 3B:
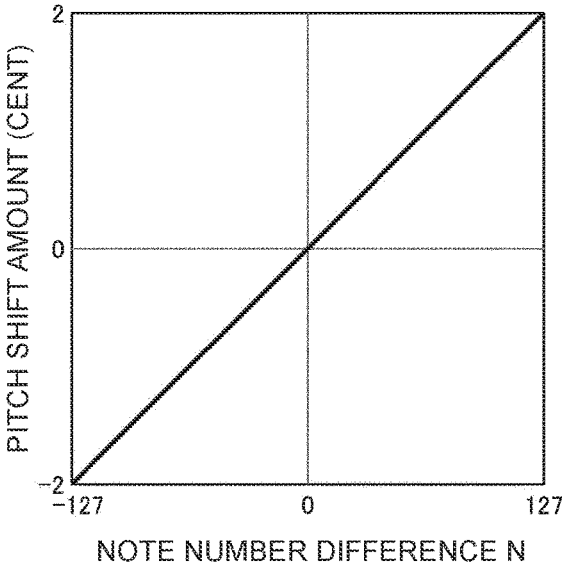
FIGS. 3A and 3B are diagrams illustrating the relationship between a note number difference and a pitch shift (pitch change) amount.

FIGS. 3A and 3B are diagrams illustrating the relationship between a note number difference and a pitch shift amount. FIG. 3A illustrates an example of a processing table T1 in which note number differences N and pitch shift amounts of waveform data are associated with each other. FIG. 3B depicts the values in the processing table T1 of FIG. 3A as a graph.

In this embodiment, the sound source LSI 17 obtains from the processing table T1 a pitch shift amount (pitch processing amount) that is to be applied to the waveform data that is determined on the basis of information of the second note-on command that causes the pitch change. As illustrated in FIGS. 3A and 3B, the pitch shift amounts can be set using cent values that express pitch ratios. "Cent" refers to a unit obtained by dividing an equal temperament semitone into 100 parts with a constant pitch ratio (that is, a unit obtained by dividing one octave into 1200 parts with a constant pitch ratio). When the obtained pitch shift amount is +2 cent, for example, the sound source LSI 17 subjects the waveform data to pitch shift processing so that the pitch of the waveform data obtained after the pitch shift processing is higher than the pitch of the original waveform data by 1/50 of a semitone. Conversely, when the obtained pitch shift amount has a minus value, the sound source LSI 17 executes pitch shift processing so that the pitch of the waveform data obtained after the pitch shift processing is lower than the pitch of the original waveform data. In the case where the obtained pitch shift amount is x cent, the sound source LSI 17 executes pitch shift processing so that the pitch comes to have a value obtained by multiplying the pitch of the original waveform data by 2(x/1200).

The pitch shift processing is executed by changing the speed at which waveform data is read out, for example. Reading out of waveform data that is compressed along the time axis direction is realized by increasing the read-out speed of the waveform data in accordance with the pitch shift amount, and the pitch is thus raised. Alternatively, reading out of waveform data that is stretched along the time axis direction is realized by decreasing the read-out speed of the waveform data in accordance with the pitch shift amount, and the pitch is thus lowered. The pitch shift processing is executed on a fundamental tone component and overtone components included in the waveform data.

In the example illustrated in FIGS. 3A and 3B, the absolute value of the pitch shift amount increases as the absolute value of the note number difference N increases (i.e., as the pitch difference between two consecutive tones increases). This is to reflect the tendency of the pitch at the beginning of the sound after a change in pitch to be more unstable the larger the change in pitch is in the sound of an actual acoustic musical instrument or the singing voice of an actual person. The values of the pitch shift amount are not limited to the example illustrated in FIGS. 3A and 3B. For example, the pitch shift amount may instead increase in a non-linear manner such as increasing in the form of an exponential function rather than increasing in a linear manner as the note number difference N increases, as illustrated in FIGS. 3A and 3B.

(3) Operation

Next, operation of the electronic musical instrument 10 will be described while referring to FIGS. 4 and 5. Hereafter, CPU processing executed by the CPU 14 will be described, and then sound source processing executed by the sound source LSI 17 will be described.

(a) CPU Processing

Figure 4:
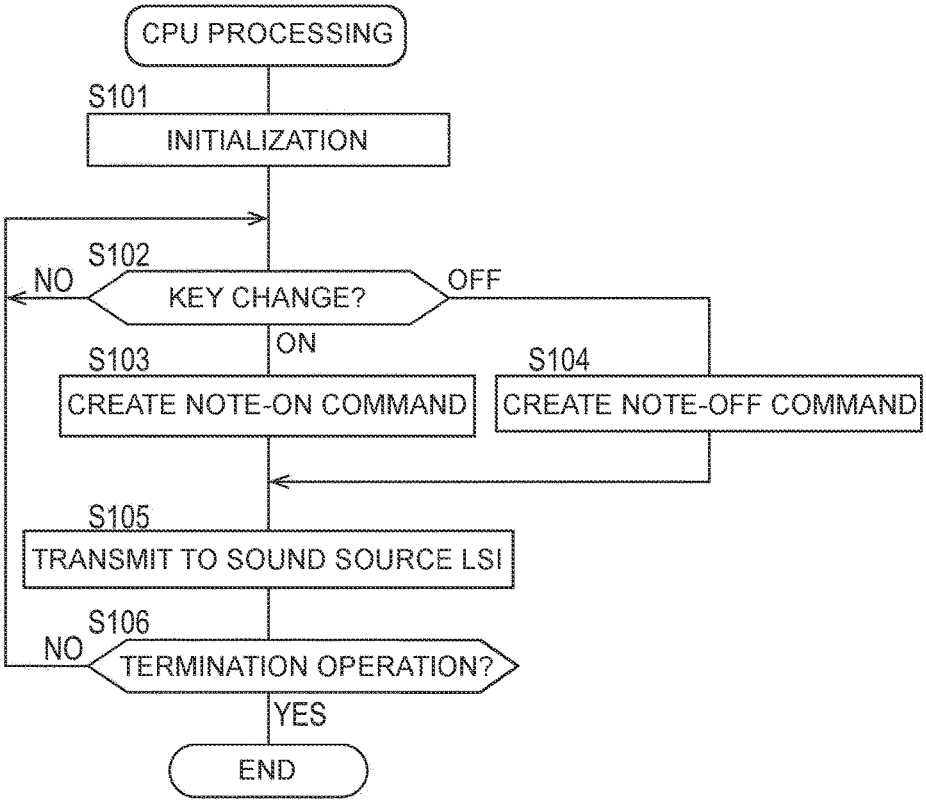
FIG. 4 is a flowchart illustrating a CPU processing procedure.

FIG. 4 is a flowchart illustrating a CPU processing procedure. The algorithm illustrated in the flowchart of FIG. 4 is stored as a program in the ROM 15 or the like, and is executed by the CPU 14.

As illustrated in FIG. 4, when power supply to the electronic musical instrument 10 is initiated by for example operating the power switch included in the switch group 12, the CPU 14 begins an initialization operation in which each part of the electronic musical instrument 10 is initialized (step S101). Once the CPU 14 has completed the initialization operation, the CPU 14 begins a change detection operation for each key in the plurality of keys 11 (step S102).

The CPU 14 stands by while there is no key change (step S102: NO) until detecting a key change. On the other hand, when there is a key change, the CPU 14 determines whether a key-on event or a key-off event has occurred. In the case where a key-on event has occurred (step S102: ON), the CPU 14 creates a note-on command that includes information consisting of a note number and a velocity value (step S103). In the case where a key-off event has occurred (step S102: OFF), the CPU 14 creates a note-off command that includes information consisting of a note number and a velocity value (step S104).

Once the CPU 14 has created the note-on command or note-off command, the CPU 14 transmits the created command to the sound source LSI 17 (step S105). The CPU 14 repeats the processing of steps S102 to S106 while a termination operation is not performed (step S106: NO) through operation of the power switch included in the switch group 12, for example. Once a termination operation has been performed (step S106: YES), the CPU 14 terminates the processing.

(b) Sound Source Processing

Figure 5:
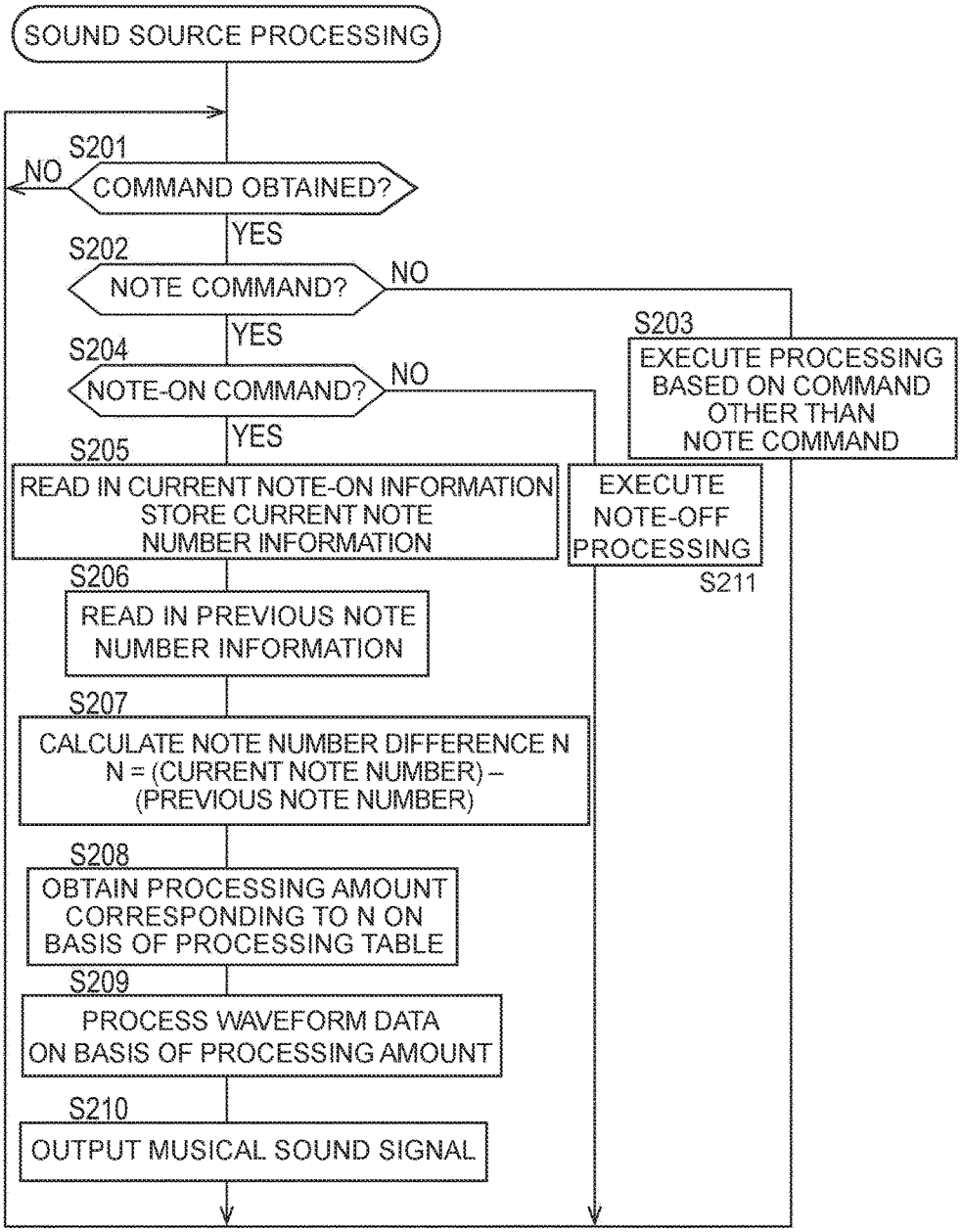
FIG. 5 is a flowchart illustrating an example of a sound source processing procedure.

FIG. 5 is a flowchart illustrating an example of a sound source processing procedure. The algorithm illustrated in the flowchart of FIG. 5 is stored as a program in the ROM 15 or the like, and is executed by the sound source LSI 17.

As illustrated in FIG. 5, the sound source LSI 17 stands by while a command is not obtained from the CPU 14 (step S201: NO) until obtaining a command. Then, upon obtaining a command (step S201: YES), the sound source LSI 17 determines whether the obtained command is a note command (step S202). The sound source LSI 17 may obtain the command by receiving the command directly from the CPU 14, or may obtain the command via a shared buffer, for example.

In the case where the command is not a note command (step S202: NO), the sound source LSI 17 executes various processing based on commands other than a note command (step S203). After that, the sound source LSI 17 returns to the processing of step S201.

In the case where the command is a note command (step S202: YES), the sound source LSI 17 determines whether the obtained command is a note-on command (step S204).

In the case where the command is a note-on command (step S204: YES), the sound source LSI 17 advances to the processing of step S205. Then, the sound source LSI 17 executes reading-in processing in which note-on information is read in, and in addition stores the note number (hereafter referred to as "current note number (second pitch)") information included in the note-on information in the ROM 15 or the like (step S205). Thus, the sound source LSI 17 stores the note number information each time a note-on command is obtained. Then, the sound source LSI 17 executes reading-in processing in which information of the note number stored last time (hereafter referred to as "previous note number (first pitch)") is read in from the ROM 15 or the like (step S206). The order in which steps S205 and S206 are executed may be reversed.

Next, the sound source LSI 17 executes difference value calculation processing (step S207) in which a note number difference N, which is a difference value corresponding to the difference between the current note number and the previous note number read in through the reading-in processing executed in steps S205 and S206, is calculated. Then, the sound source LSI 17 obtains a pitch shift amount (step S208), which is a processing amount corresponding to the note number difference N, which was calculated in the difference value calculation processing in step S207, on the basis of the processing table T1 stored in the ROM 15 or the like as illustrated in FIG. 3A. In addition, the sound source LSI 17 executes pitch shift processing (step S209), which is processing based on the processing amount obtained in step S208, on the waveform data determined on the basis of the note-on information. In other words, the sound source LSI 17 executes processing in accordance with the note number difference N calculated in the difference value calculation processing in step S207.

Next, the sound source LSI 17 executes output processing (step S210) of outputting a digital musical sound signal based on the processed waveform data, which was obtained in the processing performed in step S209. The output digital musical sound signal is subjected to analog conversion and so forth by the sound-producing system 18, and is output as musical sound as described above.

As illustrated in FIG. 1, in the sound of an acoustic musical instrument such as a string instrument or a wind instrument and in the singing voice of a person, a shift occurs in the pitch of the sound after there has been a change in pitch, and then this shift disappears. Therefore, in order to reproduce this change in the electronic musical instrument 10, the output processing of step S210 may be processing in which processed waveform data is output, and then unprocessed waveform data that has not been subjected to the processing is output. In other words, processed second waveform data that is obtained by performing processing on a beginning part of second waveform data corresponding to the second pitch may be output in response to the second pitch being specified by the second key, and then unprocessed second waveform data that is obtained by not performing the processing on a part subsequent to the leading part of the second waveform data may be output.

On the other hand, in the case where the command obtained in step S201 is not a note-on command (step S204: NO), that is, in the case where the command is a note-off command, the sound source LSI 17 executes note-off processing (step S211). After that, the sound source LSI 17 returns to the processing of step S201.

The sound source LSI 17 repeats the processing of steps S202 to S211 each time a new command is received in step S201. In other words, as the processing flow, first, the sound source LSI 17 reads in first note-on information, which is information consisting of a certain first note-on command, and then executes first output processing in which first waveform data determined on the basis of the first note-on information is output. Although the first waveform data may have been subjecting to processing, the first waveform data may be unprocessed waveform data in the case where the first note-on information is information regarding the first note-on command that was created after the electronic musical instrument 10 was turned on. After that, the sound source LSI 17 reads in second note-on information, which is information regarding the next note-on command, and then executes second output processing in which processed second waveform data determined on the basis of the second note-on information is output.

Furthermore, this embodiment has been described while assuming that the sound production instruction supplied to the sound source LSI 17 is a note-on command, but the embodiment is not limited to this example. That is, the sound production instruction may be a command based on some arbitrary specification other than a note-on command. Therefore, the sound production instruction information may also be sound production instruction information based on arbitrary specification other than note-on information.

As described above, according to the electronic musical instrument 10 of this embodiment, the electronic musical instrument 10 first outputs first waveform data determined on the basis of first sound production instruction information. After that, the electronic musical instrument 10 subjects second waveform data determined on the basis of second sound production instruction information to processing in accordance with a difference between the first sound production instruction information and the second sound production instruction information, and outputs processed second waveform data. In this way, the electronic musical instrument 10 can reproduce the pitch shift that occurs in the sound of an actual acoustic musical instrument or the singing voice of an actual person.

Furthermore, after outputting the processed second waveform data, the electronic musical instrument 10 outputs the unprocessed second waveform data, which has not been subjected to the processing. Thus, the electronic musical instrument 10 can avoid continuing outputting the processed sound.

In addition, as the difference value increases, the electronic musical instrument 10 outputs processed second waveform data that has been processed to a greater degree. Thus, the electronic musical instrument 10 can reflect the tendency of the pitch at the beginning of the sound after a change in pitch to be more unstable the larger the change in pitch becomes in the sound of an actual acoustic musical instrument or the singing voice of an actual person.

Furthermore, the electronic musical instrument 10 subjects the second waveform data to pitch shift processing in accordance with the difference in note number information. Thus, the electronic musical instrument 10 can suitably reproduce a pitch shift that occurs after a change in pitch.

Furthermore, the electronic musical instrument 10 processes and then outputs musical sound waveform data of a wind instrument, musical sound waveform data of a string instrument, or singing voice waveform data of a singing voice. Thus, the electronic musical instrument 10 can reproduce various tone colors such as the sounds of acoustic musical instruments and the singing voice of a person in which pitch shifts can occur.

In the above-described embodiment, the electronic musical instrument 10 may have a different processing table for each tone color of an acoustic musical instrument or singing voice that is to be reproduced. If the electronic musical instrument 10 has a different processing table for each tone color, the electronic musical instrument 10 can execute the optimum processing for each tone color. Alternatively, the electronic musical instrument 10 may have a plurality of processing tables for the tone color of a single acoustic musical instrument, and the performer may select the processing table that is to be referred to via the switch group 12 and the LCD 13. If the electronic musical instrument 10 has a plurality of processing tables for a single tone color, the performer can change the processing amount of the electronic musical instrument 10 in accordance with the piece of music that is to be performed or the style of playing that the performer wishes to reproduce, for example.

Furthermore, in the above-described embodiment, an example is described in which the electronic musical instrument 10 uses a positive processing amount when the current note number is larger than the previous note number and uses a negative processing amount when the current note number is smaller than the previous note number. However, the embodiment is not limited to this example, and the electronic musical instrument 10 may instead reverse the signs of the processing amounts. In other words, a negative processing amount may be used when the current note number is larger than the previous note number, and a positive processing amount may be used when the current note number is smaller than the previous note number. Thus, the electronic musical instrument 10 can reproduce various musical performance expressions.

<Modification 1>

In the above-described embodiment, a case is described in which the electronic musical instrument 10 executes pitch shift processing in accordance with a note number difference N. In modification 1, a case will be described in which the electronic musical instrument 10 executes processing other than pitch shift processing.

As described above, when there is a change in pitch, the pitch at the beginning of the sound after the change in pitch is unstable in the sound of an actual acoustic musical instrument or the singing voice of an actual person. However, unstable elements of sound are not limited to the pitch of a sound. For example, as a result of it being difficult to control production of sound when causing the pitch of the sound to change, the volume of the sound produced after the change in pitch is also likely to be unstable. Accordingly, an electronic musical instrument 10 of modification 1 executes volume change processing on waveform data determined on the basis of the information of the second note-on command in accordance with a note number difference N.

A sound source LSI 17 of modification 1 executes processing that is different from that in the above-described embodiment in steps S208 and S209 when executing the processing in FIG. 5.

FIG. 6 is a diagram illustrating the relationships between a note number difference, a pitch shift amount, and a volume change amount.

In step S208, the sound source LSI 17 obtains a processing amount on the basis of a processing table T2 illustrated in FIG. 6 instead of the processing table T1 illustrated in FIG. 3A. As illustrated in FIG. 6, the processing table T2 includes not only pitch shift amounts but also volume change amounts as processing amounts. Therefore, the sound source LSI 17 obtains either a pitch shift amount or a volume change amount as a processing amount, or obtains both a pitch shift amount and a volume change amount as processing amounts. In the example illustrated in FIG. 6, the absolute values of the pitch shift amount and the volume change amount increase as the absolute value of the note number difference N increases (i.e., as the pitch difference between two consecutive tones increases). This is to reflect the tendency of the pitch and the volume at the beginning of the sound after a pitch change to be more unstable the larger the change in pitch is in the sound of an actual acoustic musical instrument or the singing voice of an actual person. The values of the volume change amount are not limited to the examples illustrated in FIG. 6. In addition, although the volume change amounts are set using units of decibels in the example illustrated in FIG. 6, the volume change amounts may instead be set using different units.

In step S209, the sound source LSI 17 executes pitch shift processing and/or volume change processing on waveform data on the basis of a pitch shift amount and/or a volume change amount according to the processing table T2. In other words, the sound source LSI 17 executes either pitch shift processing or volume change processing as processing, or executes both pitch shift processing and volume change processing as processing. In the case where the sound source LSI 17 executes both pitch shift processing and volume change processing, either processing may be executed first. The processing to be executed in step S209 may be selected in advance by the performer via the switch group 12 and the LCD 13.

As described above, according to the electronic musical instrument 10 of modification 1, volume change processing in accordance with a difference in note number information can also be executed on the second waveform data. Thus, the electronic musical instrument 10 can also appropriately reproduce the unstableness of volume that occurs after a change in pitch in the sound of an actual acoustic musical instrument or the singing voice of an actual person.

<Modification 2>

In the above-described embodiment, a case is described in which the electronic musical instrument 10 executes processing in accordance with a note number difference N. In modification 2, a case will be described in which the electronic musical instrument 10 executes processing in accordance with a parameter other than the note number difference N.

As described above, when there is a change in pitch, the beginning of the sound after the change in pitch is unstable in the sound of an actual acoustic musical instrument or the singing voice of an actual person. However, the cause of the unstableness at the beginning of the sound is not limited to being a change in pitch. For example, when attempting to continuously produce a sound of the same pitch at different volumes, the beginning of the sound after a change in volume is also likely to be unstable due to it being difficult to control production of sound while changing the volume of the sound. Accordingly, an electronic musical instrument 10 of modification 2 may be configured to execute pitch shift processing or volume change processing on waveform data that is determined on the basis of second note-on command information, in accordance with a difference between velocity information included in two consecutive note-on commands.

A sound source LSI 17 of modification 2 executes different processing from the above-described embodiment in steps S205 to S209 when executing the processing in FIG. 5.

In step S205, the sound source LSI 17 executes reading-in processing in which note-on information is read in, and stores information of the velocity (hereafter, referred to as "current velocity") included in the note-on information instead of the current note number information. In addition, in step S206, the sound source LSI 17 reads in information of the velocity stored the previous time (hereafter, referred to as "previous velocity") instead of the previous note number information. In addition, in step S207, the sound source LSI 17 calculates a velocity difference V, which is a difference value corresponding to the difference between the current velocity and the previous velocity.

FIG. 7 is a diagram illustrating the relationships between a velocity difference, a pitch shift amount, and a volume change amount.

In step S208, the sound source LSI 17 obtains a processing amount on the basis of a processing table T3 illustrated in FIG. 7. As illustrated in FIG. 7, the processing table T3 includes processing amounts corresponding to velocity differences V. In the example illustrated in FIG. 7, the processing table T3 includes both pitch shift amounts and volume change amounts, but the processing amounts included in the processing table T3 are not limited to this example, and the processing table T3 may instead include only pitch shift amounts or only volume change amounts. The sound source LSI 17 obtains either a pitch shift amount or a volume change amount as a processing amount, or obtains both a pitch shift amount and a volume change amount as processing amounts.

In step S209, the sound source LSI 17 executes pitch shift processing and/or volume change processing on the waveform data on the basis of a pitch shift amount and/or a volume change amount according to the processing table T3. The processing to be executed in step S209 may be selected in advance by the performer via the switch group 12 and the LCD 13.

As described above, according to the electronic musical instrument 10 of modification 2, processing in accordance with a difference in velocity information can be executed on second waveform data. Thus, the electronic musical instrument 10 is also able to appropriately reproduce an instability that occurs in a produced sound after a change in volume.

In addition, although a case is described in modification 2 in which the electronic musical instrument 10 executes processing in accordance with a difference in velocity information, this processing may be executed in combination with processing according to a difference in note number information as in modification 1. The electronic musical instrument 10 may, for example, obtain a pitch shift amount corresponding to a velocity difference V on the basis of the processing table T3 illustrated in FIG. 7 while also obtaining a pitch shift amount corresponding to a note number difference N on the basis of the processing table T2 illustrated in FIG. 6. Then, in the case where, for example, the pitch shift amount corresponding the note number difference N is +1 cent and the pitch shift amount corresponding to the velocity difference V is +0.5 cent, the electronic musical instrument 10 may use a total pitch shift amount of +1.5 cent as the pitch shift amount in the pitch shift processing. Alternatively, the electronic musical instrument 10 may use the larger pitch shift amount of +1 cent as the pitch shift amount.

<Modification 3>

In the above-described embodiment, a case is described in which the electronic musical instrument 10 executes processing in accordance with a difference between information included in two consecutive note-on commands. In modification 3, a case is described in which the electronic musical instrument 10 executes processing in accordance with a difference between the read-in times of the information of two consecutive note-on commands.

As described above, when there is a change in pitch and/or volume, the beginning of the sound after the change in pitch and/or volume is unstable in the sound of an actual acoustic musical instrument or the singing voice of an actual person. However, the cause of this instability at the beginning of the sound is not limited to changes in pitch and volume. For example, in the case where a musical instrument is played rapidly (for example, shredding), the pitch and volume of the produced sound are likely to be unstable due to the difficulty of controlling the production of sound. Accordingly, an electronic musical instrument 10 of modification 3 executes processing on waveform data that is determined on the basis of second note-on command information, in accordance with a difference between the read-in times of the information of two consecutive note-on commands.

Figure 8:
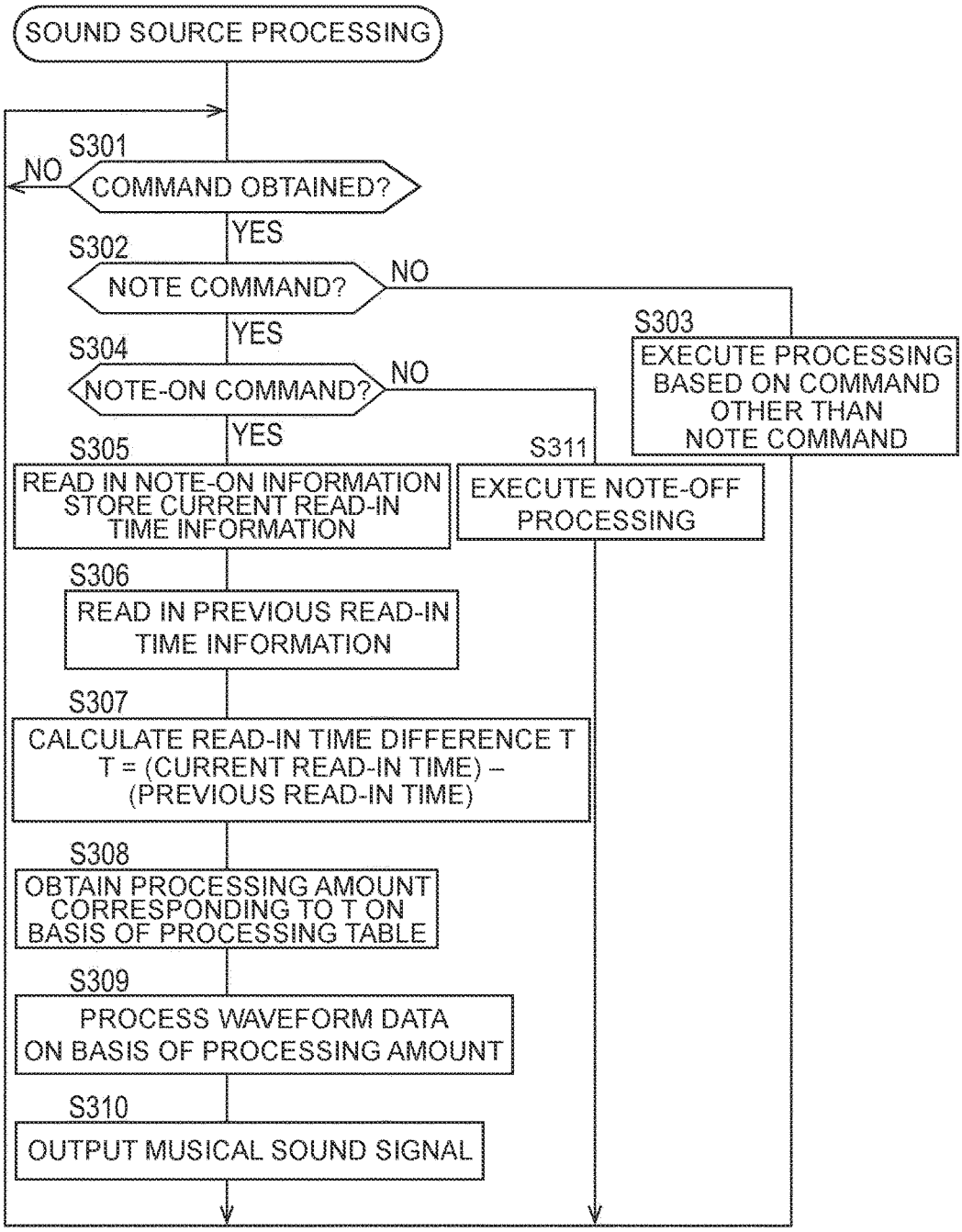
FIG. 8 is a flowchart illustrating another example of a sound source processing procedure.

FIG. 8 is a flowchart illustrating another example of a sound source processing procedure. FIG. 9 is a diagram illustrating the relationships between a read-in time difference, a pitch shift amount, and a volume change amount. The algorithm illustrated in the flowchart of FIG. 8 is stored as a program in the ROM 15 or the like, and is executed by the sound source LSI 17. The processing performed in steps S301 to S304, S310, and S311 in FIG. 8 is identical to the processing performed in steps S201 to S204, S210, and S211 in FIG. 5, and therefore description of these steps is omitted.

In step S304, in the case where the obtained command is a note-on command (step S304: YES), the sound source LSI 17 advances to the processing of step S305. Then, the sound source LSI 17 executes reading-in processing in which the note-on information is read in, and additionally stores information detailing the time at which the note-on information was read in (hereafter, referred to as "current read-in time") in the ROM 15 or the like (step S305). Furthermore, the sound source LSI 17 executes reading-in processing in which information of the read-in time stored the previous time (hereafter, referred to as "previous read-in time") is read in from the ROM 15 or the like (step S306).

Next, the sound source LSI 17 executes time difference calculation processing in which a read-in time difference T, which is a difference value corresponding to the difference between the current read-in time and the previous read-in time that were read in during the reading-in processing performed in steps S305 and S306, is calculated (step S307). Then, the sound source LSI 17 obtains a processing amount corresponding to the read-in time difference T calculated in the time difference calculation processing performed in step S307 on the basis of a processing table T4 illustrated in FIG. 9 (step S308). As illustrated in FIG. 9, the processing table T4 includes processing amounts that correspond to read-in time differences T. Although the processing table T4 includes numerical values of the pitch shift amount and the volume change amount for read-in time differences T in the range of 50 to 1000 ms in the example illustrated in FIG. 9, the numerical values included in the processing table T4 are not limited to this example.

In addition, the sound source LSI 17 executes processing based on the processing amount obtained in step S308 on the waveform data determined on the basis of the note-on information (step S309). The sound source LSI 17 does not execute the processing in the case where read-in time difference T calculated in step S307 is not included in the range of read-in time differences T in the processing table T4. In the example illustrated in FIG. 9, the sound source LSI 17 does not execute the processing unless the read-in time difference T calculated in step S307 is greater than or equal to 50 ms and less than or equal to 1000 ms.

As described above, according to the electronic musical instrument 10 of modification 3, processing in accordance with a difference between read-in time information can be executed on second waveform data. Thus, the electronic musical instrument 10 can also appropriately reproduce unstableness in sound produced in the case where a musical instrument is played rapidly or the case of fast singing in the sound of an actual acoustic musical instrument or the singing voice of an actual person.

In modification 3, an example is described in which the electronic musical instrument 10 executes processing in accordance with a difference between the times at which note-on information is read in, but the embodiment is not limited to this example. The electronic musical instrument 10 may store information regarding the a time at which note-off information is read in rather than store information regarding time at which note-on information is read in. Then, the electronic musical instrument 10 may calculate a read-in time difference T between the time at which current note-on information is read in and the time at which previous note-off information is read in in step S307. Thus, the electronic musical instrument 10 can execute processing on the basis of a time period from when outputting of waveform data corresponding to a previous (first) note-on command finishes until outputting of waveform data corresponding to a current (second) note-on command begins.

Furthermore, the electronic musical instrument 10 may execute processing that is a combination of modification 1, modification 2, and modification 3. In other words, the electronic musical instrument 10 may obtain a pitch shift amount and/or a volume change amount, and execute processing on the basis of a note number difference N, a velocity difference V, and/or a read-in time difference T.

Furthermore, the present invention is not limited to being applied to an electronic musical instrument, and for example may be applied in a case where sound is output on the basis of a MIDI sound source when producing a musical composition using a PC.

In addition, the present invention is not limited to the above-described embodiment, and can be modified in various ways in the implementation phase within a range that does not deviate from the gist of the present invention. Furthermore, the functions executed in the above-described embodiment may be appropriately combined with each other as much as possible. A variety of stages are included in the above-described embodiment, and a variety of inventions can be extracted by using appropriate combinations constituted by a plurality of the disclosed constituent elements. For example, even if some constituent elements are removed from among all the constituent elements disclosed in the embodiment, the configuration obtained by removing these constituent elements can be extracted as an invention provided that an effect is obtained. Thus, it is intended that the present invention cover modifications and variations that come within the scope of the appended claims and their equivalents.

What is claimed is:

1. An electronic musical instrument comprising:

a plurality of keys respectively specifying different pitches when operated;

a memory; and a sound processor that executes the following:

in response to an operation of any one of the keys, generating waveform data corresponding to a pitch specified by the operated key; and storing information on said operation of the operated key in the memory, wherein in response to a current operation of a current key, which is one of the plurality of keys, the sound processor retrieves the information stored in the memory for a previous operation, if any, of a previous key, which is a same as the current key or is another one of the plurality of keys, and performs a waveform processing on a beginning part of the waveform data generated for the current operation of the current key in accordance with the retrieved information stored in the memory for the previous operation of the previous key so as to generate processed waveform data in response to the current operation of the current key, wherein the sound processor causes the processed waveform data to output as a sound, and wherein the waveform processing includes pitch shift processing that changes a pitch of the beginning part of the waveform data generated for the current operation of the current key such that as an absolute difference in note number between the previous key and the current key increases, an absolute value of the pitch change increases.

2. The electronic musical instrument according to claim 1, wherein the waveform processing includes volume change processing that changes a volume of the beginning part of the waveform data.

3. The electronic musical instrument according to claim 1, wherein said information includes pitch information indicating a pitch specified by the operated key, and the sound processor performs said waveform processing to a greater level when a difference in pitch between the current key and the previous key is greater.

4. The electronic musical instrument according to claim 1, wherein when the pitch specified by the current key is higher than the pitch specified by the previous key, the sound processor raises a pitch of the beginning part of the waveform data generated for the current operation of the current key higher than the pitch specified by the current key in performing the waveform processing.

5. The electronic musical instrument according to claim 1, wherein when the pitch specified by the current key is lower than the pitch specified by the previous key, the sound processor lowers a pitch of the beginning part of the waveform data generated for the current operation of the current key lower than the pitch specified by the current key in performing the waveform processing.

6. The electronic musical instrument according to claim 1, wherein said information includes timing information indicating a timing of said operation of any one of the keys, and the sound processor performs the waveform processing only when a time difference between the current operation of the current key and the previous operation of the previous key is smaller than or equal to a prescribed time difference.

7. The electronic musical instrument according to claim 1, wherein the waveform data includes at least one of musical sound waveform data of a wind instrument, musical sound waveform data of a string instrument, and singing voice waveform data of a singing voice.

8. The electronic musical instrument according to claim 1, wherein said information includes velocity information indicating an operating velocity at which said operation of any one of the keys is performed, and wherein the sound processor performs the waveform processing on the beginning part of the waveform data generated for the current operation of the current key in accordance with a difference in operating velocity between the current key and the previous key.

9. The electronic musical instrument according to claim 1, wherein said information includes pitch information indicating a pitch specified by the operated key, and the sound processor performs said waveform processing on the beginning part of the waveform data generated for the current operation of the current key only when the pitch specified by the current key is different from the pitch specified by the previous key.

10. A method performed by a sound processor in an electronic musical instrument that includes a plurality of keys respectively specifying different pitches when operated; a memory; and said sound processor, wherein in response to an operation of any one of the keys, said processor generates waveform data corresponding to a pitch specified by the operated key; and stores information on said operation of the operated key in the memory, the method comprising:

in response to a current operation of a current key, which is one of the plurality of keys, retrieving the information stored in the memory for a previous operation, if any, of a previous key, which is a same as the current key or is another one of the plurality of keys;

performing a waveform processing on a beginning part of the waveform data generated for the current operation of the current key in accordance with the retrieved information stored in the memory for the previous operation of the previous key so as to generate processed waveform data in response to the current operation of the current key; and causing the processed waveform data to output as a sound, and wherein the waveform processing includes pitch shift processing that changes a pitch of the beginning part of the waveform data generated for the current operation of the current key such that as an absolute difference in note number between the previous key and the current key increases, an absolute value of the pitch change increases.

11. A non-transitory computer-readable storage medium having stored thereon a program executable by a sound processor in an electronic musical instrument that includes a plurality of keys respectively specifying different pitches when operated; a memory; and said sound processor, wherein in response to an operation of any one of the keys, said processor generates waveform data corresponding to a pitch specified by the operated key; and stores information on said operation of the operated key in the memory, the program causing the sound processor to perform the following:

in response to a current operation of a current key, which is one of the plurality of keys, retrieving the information stored in the memory for a previous operation, if any, of a previous key, which is a same as the current key or is another one of the plurality of keys;

performing a waveform processing on a beginning part of the waveform data generated for the current operation of the current key in accordance with the retrieved information stored in the memory for the previous operation of the previous key so as to generate processed waveform data in response to the current operation of the current key; and causing the processed waveform data to output as a sound, wherein the waveform processing includes pitch shift processing that changes a pitch of the beginning part of the waveform data generated for the current operation of the current key such that as an absolute difference in note number between the previous key and the current key increases, an absolute value of the pitch change increases.

* * * * *